United States Patent [19]

Michel

[11] 4,268,307

[45] May 19, 1981

[54] METHOD OF EXTRACTION OF METALS FROM LOW GRADE ORES

[76] Inventor: Robert Michel, 9457 Las Vegas Blvd. South, #151, Las Vegas, Nev. 89119

[21] Appl. No.: 92,377

[22] Filed: Nov. 8, 1979

[51] Int. Cl.[3] ..... C22B 11/08

[52] U.S. Cl. ..... 75/101 R; 75/105; 75/106; 75/107; 75/118 R; 423/29; 423/31

[58] Field of Search ..... 75/101 R, 105, 106, 75/107, 118 R; 423/28, 29, 31

[56] References Cited

U.S. PATENT DOCUMENTS 1,156,382 10/1915 Towne et al. ..... 75/118 R 2,266,155 12/1941 Bonesteel ..... 75/118 R 3,443,932 5/1969 Melin et al. ..... 75/101 R

*Primary Examiner*—G. Ozaki

[57] ABSTRACT

A continuous process for recovery of metals, especially precious metals, from various ores, involves pulverizing the ore to a particle size less than five microns, forming a colloidal suspension of the particles in a liquid, extracting metal from the slurry with a solvent, and separating the solvent from the particles centrifugally. Metals are recovered from the liquid solvent, which is recycled. Contacting of the slurry with fresh solvent is preferably effected in a staged counter-current centrifugal extraction unit.

14 Claims, 2 Drawing Figures

METHOD OF EXTRACTION OF METALS FROM LOW GRADE ORES

BACKGROUND OF THE INVENTION

This invention relates to a process for the extraction and recovery of metals from ores, particularly low grade ores, by grinding the ores to an extremely small particle size, forming a substantially homogeneous aqueous slurry of the particles, and extracting metals from the slurry with a solvent in a counter-current liquid-slurry extraction step.

In the past, many processes for the extraction and recovery of precious metals, such as gold and silver, from ores by hydrometallurgical methods have been well known. The present invention is an improvement on the cyanide process, although in principle any liquid material which acts as a solvent for precious metals may be used. The cyanide process has been known since the late 19th century. In this process, finely divided ore is treated with a dilute solution of potassium or sodium cyanide, air, and a base (for pH control). Gold, silver, and other metals, such as copper, react with the cyanide solution in the presence of oxygen and are dissolved. The chemistry of this process, known as the MacArthur process, is as follows:

$$4NaCN + 2Au + \tfrac{1}{2}O_2 + H_2O \rightarrow 2NaAU(CN)_2 + 2NaOH$$

Recovery of the dissolved metals is effected by treating the solution with elemental zinc or aluminum dust.

The cyanide process has not been economical for use in low grade ores, and the reaction rate of dissolution of the gold from the ore is so slow that the process must be carried out on a batch basis. Indeed, the process is typically operated by dumping raw materials into a vessel, and leaching the materials with a cyanide solution for a period ranging from one or two days to weeks and even months before even modest levels of recovery were achieved. For many ores, a 50% recovery of gold was considered quite successful.

Because of its limited product recovery and time-consuming nature, this process has proven commercially useful only for rich or fairly good grade ores. In addition, in processes wherein the cyanide solution was percolated either upwardly or downwardly through crushed ore, the portion of the ore having a particle size below about 3 mm was rejected to facilitate the movement of the solution through the rock; as a result, losses as high as 30% of the metal were attributed to these unprocessed fines. Because of the slow reaction rate, in addition to sedimentation and abrasion problems caused by the handling of large size particles, processes of the prior art have always been operated on a batch basis. No liquid extraction process for removal of trace quantities of metals from ores has been successfully operated on a continuous basis.

According to the present invention, a process for the continuous extraction of metals from ores is provided in which the ore is first ground or pulverized to a submicron size, a substantially homogeneous aqueous slurry of the pulverized particles is formed, and the slurry is contacted with a liquid solvent for the metals to be recovered in a counter-current centrifugal extraction step. It has been found that when the metal containing ore is ground to submicron size, the dissolution of metal when contacted by solvent is substantially instantaneous. By way of comparison, in the normal leaching process wherein a pile of crushed ore is leached by contact with cyanide solution for one month to provide a recovery of less than 50%, the speed of reaction when contacting a submicron size particle of the same rock is less than ½ second. In addition, it has been found that because an aqueous slurry of the submicron size particles can be handled and pumped as a homogeneous liquid, the slurry can be treated in a liquid-liquid extraction process in the same manner as an extraction process involving two immiscible liquids are processed. This sequence of process steps enables an entirely continuous process operation, permitting very good quality control of processing parameters, and resulting in an extraction of in excess of 90% of the metal content of the ore. As a result, very low grade ores which are normally discarded as tailings or scrap can be economically processed according to the invention.

Accordingly, it is an object of the present invention to provide a continuous process for the extraction of metals from low grade ores. It is a further object of the invention to provide a process wherein the ore is ground to a sufficiently small particle size to permit handling of slurries of the ore as liquids. It is yet a further object of the invention to provide a simple process for the extraction of metals in a substantially homogeneous slurry by contacting the slurry with an aqueous solvent for the metals to be extracted, and for separating a liquid extract and a solid waste product therefrom in conventional equipment. These and other objects of the invention will be apparent from the following detailed description of a preferred embodiment thereof.

BRIEF SUMMARY OF THE INVENTION

A method for recovering metals from an ore containing a minor amount of the metals comprises pulverizing the ore to a submicron particle size, continuously contacting a substantially homogeneous liquid slurry of pulverized particles with a liquid comprising a solvent for said metals to form a mixture, continuously centrifugally separating from the mixture a first product comprising a substantially solids-free liquid containing dissolved metals and a second product comprising pulverized ore, and processing said first product to recover metal.

BRIEF DESCRIPTION OF THE DRAWINGS

The invention is best understood with reference to the drawings, in which.

DETAILED DESCRIPTION OF THE INVENTION

The first step in the recovery of metals from ore according to the invention is pretreatment of the ore. The term "ore" as used herein is intended to mean any material having elemental or combined metals from which the metals are desired to be removed. Recovery of precious metals, such as gold, silver, platinum, and the like from mineral deposits is primarily contemplated; these deposits may be mined by open pit, strip, or underground mining, or may be recovered from sand and gravel by placer mining. The extraction of metals from talc deposits, and from used catalysts such as petroleum processing catalysts is also contemplated.

Scrap from electronics and semiconductor fabrication may also be used as a raw material, or "ore", in accordance with the invention. In addition, becuase of the ability of the process of the invention to economically recover metals from raw materials having low concentrations of the metals, sources such as dried slimes from settling ponds and other discarded tailings from processing plants may also be used.

Because of the wide variety of products which may be used as raw materials for the process of the invention, pretreatment of the ores will necessarily differ with the various starting materials. For example, for a placer product in which metals exist already in a free state, a simple screening and washing of the ore provides a relatively rich concentrate. Typically, a placer product would be dry screened to remove particles over 100 mm, and would be washed in one or more trommels. The mixture is then fed to a sluice having spaced riffles for gravity recovery of the gold ore. The produce is then crushed to a size of less than 3 mm, and is ready for the chemical processing of the invention.

Figure 1:
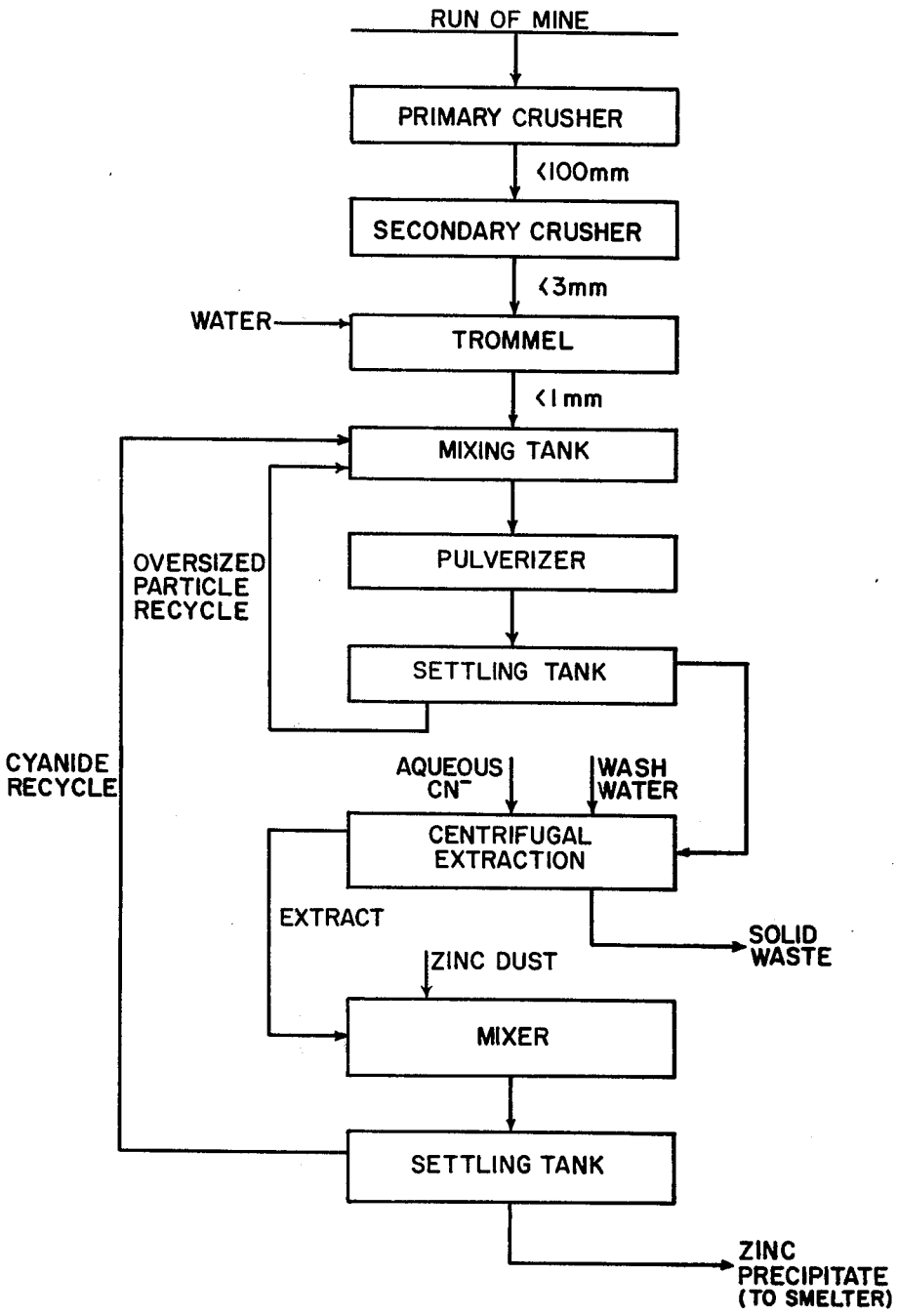
FIG. 1 is a general block flow diagram showing the recovery of gold and silver from a mine using the process of the invention.

A typical block flow diagram for pretreatment and processing according to the invention is shown in FIG. 1 for mined ore. The run of the mine, which generally consists of large chunks of rock, is fed to a primary crusher where the product size is reduced to less than 100 mm. The product is then fed to a secondary crusher for reduction to less than 3 mm, and then to a trommel for screening of all particles greater than 1 mm. In each step, oversized material is discarded; generally, the ore rich in metals is relatively easily crushed, and most of the metals are concentrated in the smaller particles. The extent of crushing depends upon the characteristics of the ore being processed; the amount of ore discarded in the crushing process may range from 20 to 30% up to 97%, depending on where the precious metals are found.

Referring to FIG. 1, screened particles (100% passing a 14 mesh screen) are fed to a mixing tank having a controlled pH along with a dilute aqueous cyanide recycle stream. A slurry containing about 50% solvents is then fed to a pulverizer, where the ore is ground to a size no greater than 5 microns, with an average size of about 1 micron. Effluent from the pulverizer is fed to a settling tank, where oversized particles are separated by gravity and recycled to the mixing tank. Overflow from the settling tank is fed to a centrifugal extractor, along with fresh aqueous cyanide solution and wash water, wherein the slurry is contacted counter-currently with the aqueous cyanide, and the particles are removed as a very thick, but pumpable, slime. At this point, precious metals are concentrated in a substantially solids-free aqueous extract, which may then be processed by conventional metal recovery means. As shown in the block flow diagram, the extract is fed to a mixer along with elemental zinc dust and is subjected to violent agitation; the mixed product is then sent to a settling tank wherein the zinc and precious metals are removed as a precipitate, and the aqueous cyanide fluid is recycled to the mixing tank for use with the ore feed. Recoveries of precious metals from the pretreated ore exceed 90%, and are commonly 97–98%.

Figure 2:
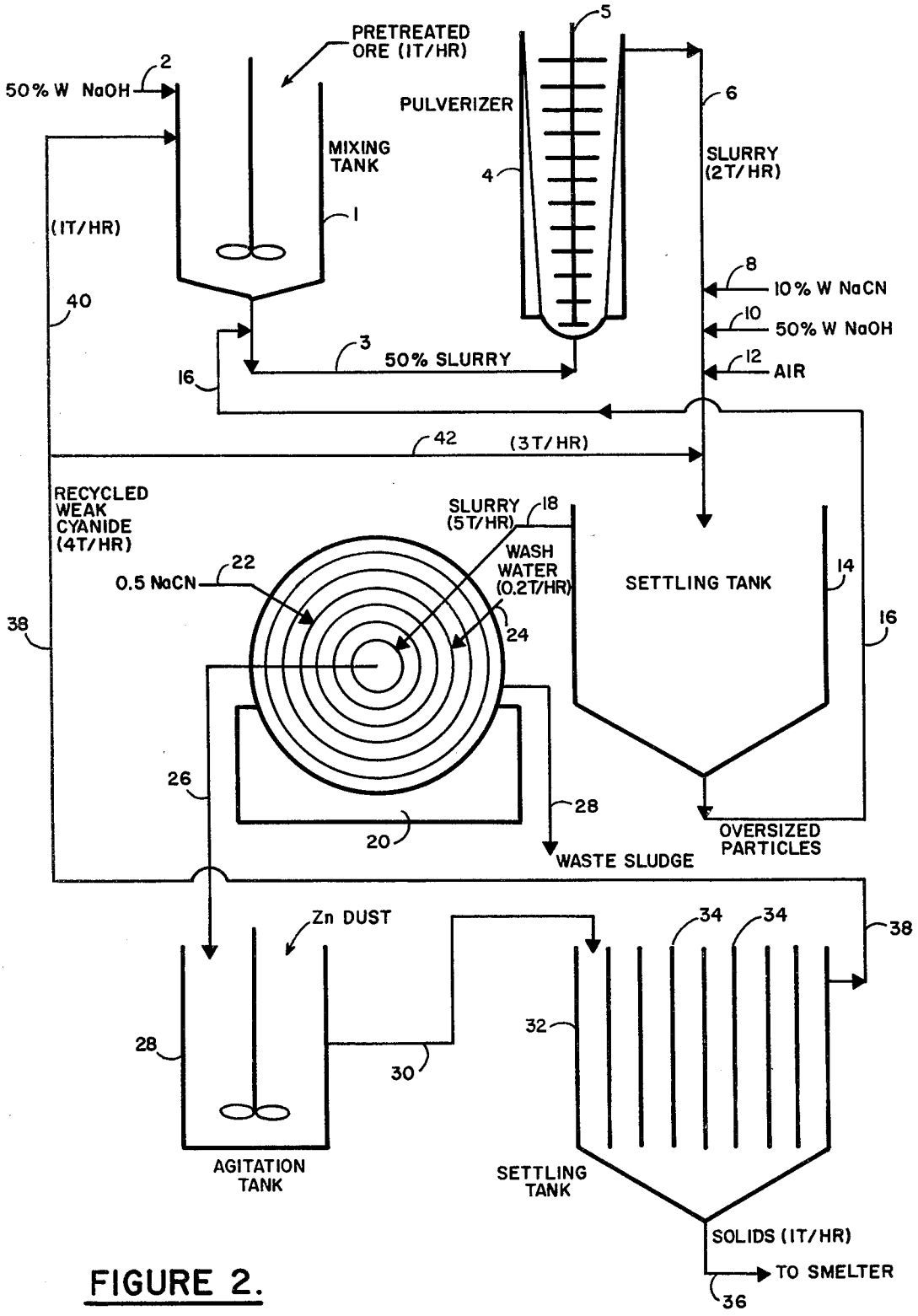
FIG. 2 is a more detailed flow diagram of the process of the invention, showing a specific usage thereof.

A specific example of the recovery of gold from pretreated ore is shown in FIG. 2. Referring to the drawing, one ton/hr of ore which has been crushed to $<1$ mm (100% through a 14 mesh screen) is mixed in a tank 1 with about 1 ton/hr of a weak recycled sodium cyanide solution fed to the tank through line 40. A 50% aqueous solution of caustic soda is added as necessary through line 2 to maintain the pH between 10 and 11. The amount of caustic soda necessary is dependent upon the acid characteristics of the ore. A slurry containing from about 40% to about 60%w solids, preferably about 50% solids, is pumped through line 3 to a continuous pulverizer or micronizer 4, wherein the ore particles are crushed to a size less than 5 microns. While any variety of continuous grinding equipment may be used in the pulverization step, a satisfactory example of commercially available equipment is the continuous Attritor, sold by Union Process Inc., of Akron, Ohio. These continuous grinders are substantially vertical cylindrical tanks filled with steel or ceramic balls which are rotated by an axial shaft. Product enters the bottom of the unit and exits the top; the fineness of the grind is controlled by the dwell time of the material between entering and leaving the tank. In general, a dwell time of from about 5 to 10 minutes in the grinding tank will produce a product having a particle size less than 5 microns.

A slurry of finely ground ore is pumped through line 6, which is an oversize line to which is added about 3 tons/hr of recycled sodium cyanide solution through line 42. In addition, about ten cubic meters per hour of air (a substantial stoichiometric excess) is pumped into the line through line 12 to provide oxygen for the reaction between gold and cyanide, and additional caustic is added as necessary through line 10 to maintain the pH between 10 and 11. Additional 10%w sodium cyanide solution may be added through line 8 to maintain the cyanide concentration between about 0.1% to 1.0%, preferably between about 0.3% and 0.7%.

About 5 tons/hr of slurry having about 20%w solids content are pumped into a 4,000 gallon settling tank 14. After an average retention time of about 1–3 hours, particles larger than about 5 microns will settle to the bottom of the tank and are recycled through line 16 to line 3 for reprocessing in the grinding unit. The remaining particles do not settle in the tank, and are processable and handleable substantially as a homogeneous slurry. If the grinding is sufficiently efficient to produce a slurry having all particles less than 5 microns, this tank may be eliminated.

The particle size of the pulverized ore leaving the settling tank is extremely important to successful operation of the process of the invention. In general, substantially all (99+%) of the particles must be less than about 5 microns in size. The average particle size is preferably from 0.5 to 5 microns, still more preferably between 0.8 and 3 microns. Particle sizes below 5 microns form colloidal suspensions which act as a liquid or pseudoliquid; these solutions show substantially no settling of solids by gravity after six months, and are processable as a completely homogeneous liquid.

Overflow from settling tank 14 is pumped through line 18 to a continuous centrifugal extractor 20. These units are commercially available machines which combine the functions of a sieve plate column and a centrifuge in one unit. These machines are built with a series of concentric radial bands perforated with holes, and are commonly used for continuous liquid-liquid extractions. When the machine is rotated, heavy liquid which is fed to the unit at its center is thrown outward by centrifugal force, while light liquid fed at the outer periphery of the unit is moved inwardly. As the liquids pass through the holes in the bands, a series of countercurrent contacts are made producing a multiple-stage extraction. It has been found that the slurries exiting settling tank 14 may be treated as a "heavy liquid" in these units, with a fresh sodium cyanide solution being treated as a "light liquid". Accordingly, about 5 tons/hr of ore slurry is fed through line 18 to a central portion of the centrifugal extractor, and about 1200 gallons/hr of aqueous sodium cyanide having a concentration of from about 0.1 to 0.5%w and a pH of from 10 to 11 is fed through line 22 to an outer portion of the extractor. As the unit is rotated, gravity forces of about 5000 G move the ore particles outwardly through the perforations in the bands, displacing the fresh sodium cyanide solution inwardly toward the center of the unit. In addition to promoting intimate contact between the fresh cyanide solution and the finely divided ore particles, the unit concentrates the leached solids in a very thick but pumpable slurry containing from about 20 to about 60%w solids, preferably 30 to 50%w, which is discarded as waste through line 28. About one ton/hr solids is discharged through this line, with a gold loss of only about 2–3% of the total.

About 0.2 tons/hr of washwater may optionally be added through line 24 at an outer portion of the centrifugal extractor to ensure low losses of precious metals to the sludge. Alternatively, two or more centrifugal extractors may be used in series, with the first being used as an extractor for contacting the slurry with fresh cyanide solution, and the second being used to wash the solids to assure substantially complete recovery of the cyanide and precious metals. In the case of using two or more sequential centrifugal extractors, washwater is added to the concentrated slurry from the first extractor, and the liquid effluents from each are combined for further processing.

Centrifugal extractors of the type utilized in the invention are commercially available. For example, acceptable units are manufactured by Baker Perkins Inc., Saginaw, Michigan, under the trademark "POD". Pod Contractor Model No. D-18 is satisfactory for the feed quantities described in this example.

Alternatively to the centrifugal extractors, a continuous counter-current mixing step of contacting slurry with fresh cyanide, or series of steps, followed by a separate continuous separation step, may be used. While any mechanism for separating colloidal solids from a slurry may in principle be used, a continuous centrifuge is preferred.

Referring again to FIG. 2, about 4 tons/hr of substantially solids-free liquid comprising about 0.5%w solid cyanide with dissolved precious metals in the amount of from about 10 to about 100 grams per ton is fed to a conventional metal recovery process. At this point, any known method for recovering the gold from the cyanide solution is acceptable; in FIG. 2, a standard zinc recovery process is shown. According to this process, about 4 tons/hr of solution containing precious metals is pumped to agitation tank 28, where about 1–4 lb/hr of zinc dust or zinc shavings are added. The tank is subjected to strong agitation.

The excess elemental zinc precipitates gold metal; from this tank, the resulting slurry is pumped through line 30 to a settling tank 32 having a series of vertical baffles 34 which increase the path of travel of the liquid through the settling tank. About 1–3 lbs/hour of solids are removed from the bottom of the tank and are processed by conventional methods (e.g., smelting) to recover the gold, silver, and other precious metals. Liquid effluent from the settling tank is pumped through line 38 and is recycled. While the recycle stream contains some residual dissolved zinc, this zinc is insoluble in excess alkaline solution and is removed as a precipitate in the solid waste from the centrifuge. Of the 4 tons/hr of recycled cyanide solution, about 1 ton/hr is returned to the original mixing vessel 1, and about 3 tons/hr is added to line 6 which carries the ground slurry from the pulverizer to the settling tank.

Because the process of the invention is continuous, all of the cyanide solution may be recycled, and none of the precious metals are lost by discarding used processing solution. The recycled cyanide contains about 0.2 to 0.5 grams per ton of gold; however, this gold is maintained in the system and is not lost. The recycle stream also contains a small amount of dissolved zinc, which is displaced by the addition of sodium hydroxide to the solution. The zinc precipitates and is removed in the sludge at line 28. About 96% of the gold in the ore is removed with the solids at line 36. Other precious metals, such as silver, iridium, platinum, osmium, and the like are also recovered at this point of the process.

In addition to substantial economies over normal batch processing, the process of the invention has several other advantages which are significant. First of all, while normal batch processing of larger particulate ore takes days or weeks, the reaction with submicron particles is extremely fast. The entire processing of ore takes less than 3 hours in the process of the invention. Because the process is continuous and operates generally with a homogeneous slurry, labor and maintenance requirements are low. In addition, the process does not generate fumes or dust, or other pollution, and is low in corrosion and abrasion. Because of the process economies, ores having concentrations of gold as low as 0.3 ppm (0.01 oz./ton), can be processed economically.

Recovery of metals by the process of the invention may also be illustrated by the following examples.

EXAMPLE I

A gold ore mined from an open pit having gold located in veins of manganese oxide is collected at the rate of 5,000 tons per day by bulldozer. The gold concentration in the ore is about 1 ppm (0.04 oz./ton). An open pit dry screening eliminates rock size over 100 mm, which generally do not contain gold. Trommel washing separates the fines, which are rich in gold concentrate, from the gangue; product over 3 mm is discarded. The remaining concentrate, which amounts to about 3–5% of the total rock, contains 66 ppm gold and 45 ppm silver. This product is slurried with a recycled cyanide solution and processed in a pulverizer to reduce the average particle size to about 1 micron. The overflow slurry is agitated with air, adjusted to proper pH and cyanide concentration, and fed to a large settling tank where particles over 5 microns settle by sedimentation. Sediment is recycled to the grinder; a substantially homogeneous slurry is pumped through a staged counter-current centrifugal extractor where it is contacted in stages with fresh sodium cyanide solution. The clear extract from the centrifuge is processed conventionally by electrolytic means to recover the metals. Recovery of the gold is in excess of 90%.

EXAMPLE II

Copper ore containing copper oxides and sulfates are processed after crushing and concentration by conventional flotation. The enriched concentrate is mixed in a weak sulphuric acid solution having a pH of about 0–3, and is pumped in a 50% slurry to the grinding unit. The resulting slurry is diluted to 10–20% solids and particles over 5 microns are separated by gravity and recycled. The resulting colloidal slurry is fed to a centrifugal extractor where it is contacted counter-currently with weak sulfuric acid, and washed with water. The resulting solution is sent to a conventional electrolytic process for recovery; weak acid solution is recycled. Impurities, including gold, silver, and precious metals are recovered in a slime from the electrolytic process and can be conventionally separated.

EXAMPLE III

The process of the invention may also be used to remove metal contaminants from useful ores, such as talc. According to the invention, talc is crushed to a 3 mm size by dry crushing and is mixed in a tank with a weak hydrochloric or sulfuric acid solution to dissolve metal impurities such as iron and calcium carbonate. A 50% slurry of product from the mixer is then ground to an average particle size of 0.5–5 microns. The slurry is diluted to 10–20%w with a weak acid solution, and the pH adjusted to about 7. The slurry is fed to a centrifuge, where the solid is washed with water. The resulting talc slurry is dried and recovered, and the liquid extract is discarded. A similar process may also be used for demetallizing kaolin, silica, and similar products.

EXAMPLE IV

Scrap from electronic component manufacture, consisting of defective parts containing plastic, rubber, vinyl, various metals including gold, and the like, is first crushed to about 2" size and is then subjected to oxidation at about 500° F. The remaining material is crushed to 1–3 mm size, and iron-containing metals are separated magnetically. The remaining material is processed as "ore" according to the invention.

In principle, the process of the invention is applicable to any type of metal extraction where the metal or metal compounds may be dissolved by a chemical liquid. The solid product containing low metal concentration is first sized to a manageable particle size (e.g., less than about 3 mm) and is continuously fed in a slurry to a fine grinding process unit which will reduce the particle size of the material to less than 5 microns. The key to the process requires the ability to treat the ore as a liquid in a processing unit. The solvent for the metals may be added either prior to or subsequent to the grinding step. After the grinding step, the slurry is fed to a continuous centrifugal extractor wherein the slurry is contacted in multiple stages with a fresh solution of solvent. The processed slurry is concentrated in the centrifuge and is discarded as a sludge; the solids free liquid may then be processed to recover the dissolved metals. Alternatively, the ground ore may be contacted with metal solvent in a first mixing step, and the solids may then be separated from the liquid extract in a separate centrifuging step.

Accordingly, many additions and variations of the process within the scope and spirit of the invention are contemplated. Modifications of the processing steps, and utility for a number of different types of solid products and solvents would be easily apparent to those skilled in the art. Accordingly, the invention should not be considered limited by the foregoing description of a preferred embodiment thereof, but rather should be limited only by the following claims.

I claim:

1. A method for the recovery of metal from an ore containing a minor amount of said metal, comprises pulverizing the ore to a particle size of less than 5 microns, continuously contacting a slurry of pulverized particles with a liquid comprising a solvent for said metal to form a colloidal mixture having substantially all of the particles less than 5 microns in size, continuously centrifugally separating from the mixture a first product comprising a substantially solid-free liquid containing dissolved metal and a second product comprising pulverized ore, and processing said first product to recover metal.

2. The method of claim 1 wherein the metal comprises gold or silver.

3. The method of claim 1 wherein the average particle size in the slurry is from about 0.5 to about 5 microns.

4. The method of claim 1 wherein the average particle size in the slurry is from about 0.8 to about 3 microns.

5. The method of claim 1 wherein the ore is rock comprising a small amount of one or more precious metals, the method also comprising crushing the rock, discarding crushed rock particles above a preselected size, mixing crushed rock particles with a liquid to form a mixture, and pulverizing the particles in the mixture.

6. The method of claim 1 also comprising recovering recycle liquid solvent after the first product has been processed to recover metal, and contacting said recycle liquid solvent with ore.

7. The method of claim 6 wherein recycle liquid solvent is mixed with ore prior to pulverizing the ore.

8. The method of claim 1 wherein the solvent is an aqueous cyanide solution.

9. The method of claim 1 wherein the slurry is contacted with solvent in at least one multiple staged counter-current centrifugal extractor.

10. The method of claim 1 or 9 also comprising washing the second product with water, and recovering wash water along with the first product.

11. The method of claim 1 also comprising contacting ore particles with a liquid to form a mixture, feeding the mixture to the pulverization step, recovering pulverized product in a settling tank, and recovering settled particles from the settling tank.

12. The method of claim 11 also comprising returning settled particles to the pulverization step.

13. The method of claim 1 wherein the slurry is a substantially homogeneous mixture of pulverized particles and liquid solvent.

14. A method for the recovery of metal from an ore containing a minor amount of said metal comprises mixing ore particles with recycle solvent to form a mixture, pulverizing the ore in the mixture to a particle size of less than about 5 microns, separating ore particles having a particle size greater than about 5 microns to form a substantially homogeneous slurry, continuously contacting the slurry with a liquid solvent for the metal, contrifugally separating a substantially solids-free first product containing dissolved metal and a second product comprising pulverized ore, processing said first product to recover metal and recycle solvent, and reusing recycle solvent.

* * * * *